United States Patent [19]

Robertson et al.

[11] 3,943,853

[45] Mar. 16, 1976

[54] BLASTING MATS

[76] Inventors: Thomas Alexander Robertson, Sheldrake Lake RR. No. 3; John Alfred King, Box 5-1-5, SS. 2, both of Armdale, Halifax County, Nova Scotia, Canada

[22] Filed: Mar. 4, 1974

[21] Appl. No.: 448,169

[52] U.S. Cl. ..... 102/22
[51] Int. Cl.[2] ..... F42D 5/00
[58] Field of Search ..... 102/22

[56] References Cited

UNITED STATES PATENTS

| | | | |
|---|---|---|---|
| 2,806,426 | 9/1957 | Klokseth | 102/22 |
| 3,331,322 | 7/1967 | Belanger | 102/22 |
| 3,371,604 | 3/1968 | Wikner et al. | 102/22 |
| 3,793,953 | 2/1974 | Lewis | 102/22 |

FOREIGN PATENTS OR APPLICATIONS

| | | | |
|---|---|---|---|
| 120,935 | 2/1948 | Sweden | 102/22 |

*Primary Examiner*—Verlin R. Pendegrass

[57] ABSTRACT

A blasting mat made up of arcuate vehicle tire members arranged in hinged together groups. The mat has rigid joining means along its sides permitting the mat to be hingedly joined side-by-side with other mats to form a larger protective cover. The mat has means for protecting the joining means from damage during blasting.

11 Claims, 8 Drawing Figures

BLASTING MATS

BACKGROUND OF THE INVENTION

1. Field of the Invention

This invention relates to blasting mats.

This invention relates in one aspect to a blasting mat made from a plurality of resilient, flexible members which mat has rigid joining means permitting it to be readily, detachably joined to one or more similar mats to cover areas larger than the area covered by a single mat.

The resilient, flexible members forming the blasting mat preferably comprise arcuate segments cut from used vehicle tires.

2. Description of Prior Art

Blasting mats made from used vehicle tires are known as shown in Canadian Pat. No. 753,870 issued Mar. 7, 1967, to Lionel Belanger. These mats have the advantage of being relatively inexpensive yet are relatively tough and long wearing. However, the mats are made in fixed sizes. A contractor wishing to use a mat of this type for a particular job must obtain a mat of a size suited for the job. However, the mat may not be large enough, or it may be too large requiring excessive handling, for the next job. Thus the contractor must keep mats of different size on hand to efficiently handle the various jobs encountered, and this can be expensive.

Further disadvantages of the known fixed-size mats, particularly those of larger size, are the difficulty encountered in handling them in the field and also the cost in repairing or replacing them if a minor portion of the mat is damaged during blasting.

It is an object of this invention to provide a blasting mat of the type which can be readily detachably joined side-by-side to one or more similar blasting mats.

SUMMARY OF THE INVENTION

The present invention in one tangible embodiment comprises a blasting mat made of a plurality of resilient, flexible members, the mat having rigid joining means along at least one side thereof permitting it to be detachably joined to a similar mat.

The mat preferably has protective means for covering the joining means to prevent the joining means from being damaged during blasting.

The resilient, flexible members forming the mat preferably comprise arcuate, used vehicle tire segments.

BRIEF DESCRIPTION OF DRAWINGS

The invention will now be described in detail having reference to the accompanying drawings in which.

DESCRIPTION OF PREFERRED EMBODIMENTS

Figure 2:
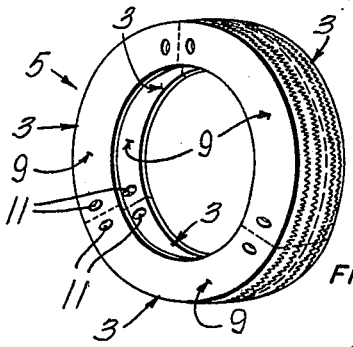
FIG. 2 is a view showing how the mat members are formed from a used vehicle tire.
Figure 2A:
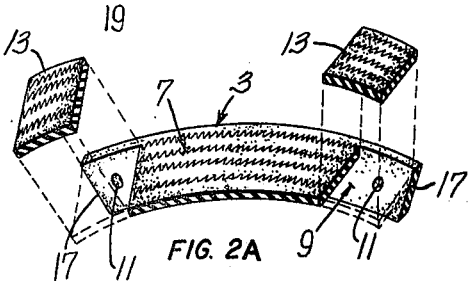
FIG. 2A is a detail view of one of the mat members.

The blasting mat 1 of the present invention comprises a plurality of flexible, resilient members 3. The members 3, one of which is shown in FIG. 2A, preferably consist of arcuate segments formed by cutting up used vehicle tires 5 in six pieces 3 as shown by dotted lines in FIG. 2. Each member 3 has a tire tread portion 7 and a tire sidewall portion 9. A hole 11 is provided at each end of one of the portions, in each member, preferably the sidewall portion 9 as shown. The holes are used in joining the members 3 together to form the blasting mat as will be described. If desired, end sections 13 of the portion not containing the holes 11, in this case the tread portion, can be removed to facilitate assembly of the mat, although this is not essential.

Figure 4:
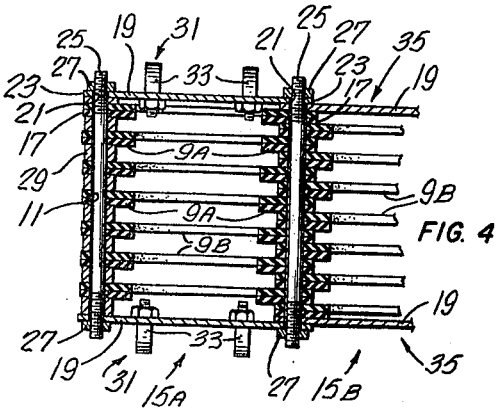
FIG. 4 is a cross-sectional view taken along line 4—4 of FIG. 1.

To form the mat, the arcuate members 3 are assembled into successive groups 15A, 15B, 15C, 15D, 15E. Five groups are shown although more groups can be used in making up a mat of a desired length. In each group the members 3 are aligned longitudinally and the sidewall portions 9 are substantially parallel. The tread portions 7 overlap. The sidewall ends 17 of the members 3 in each group are interleaved with the sidewall ends of the members in adjacent groups to an extent that the holes 11 in adjacent ends 17 are aligned as shown in FIG. 4. Rigid side plates 19 are provided on each side of each group. Each side plate 19 has a mounting hole 21 at each end 23. The ends of the side plates of adjacent ones of groups 15A, 15B, etc. overlap with the holes 21 aligned. The aligned holes 21 are also aligned with the aligned holes 11 in the interleaved members.

Figure 3:
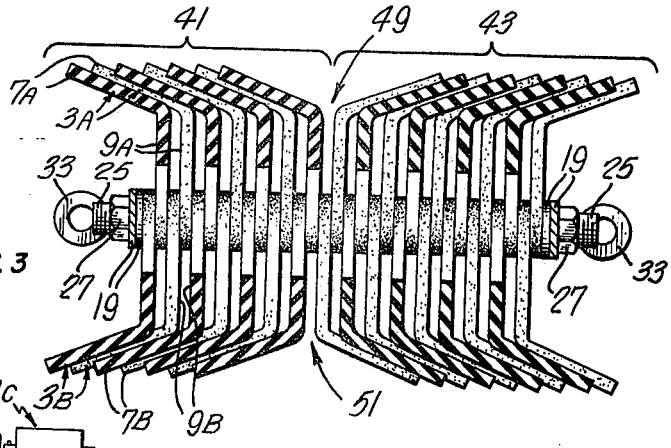
FIG. 3 is a cross-sectional view taken along line 3—3 of FIG. 1 showing a detail of the mat.
Figure 7:
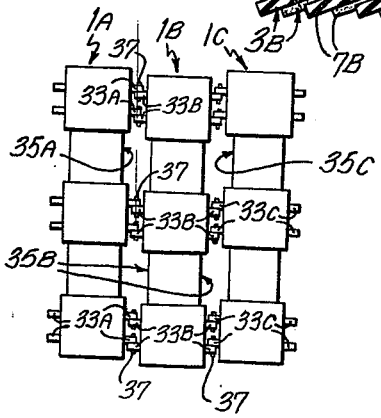
FIG. 7 which is located next to FIG. 4, shows how a plurality of the blasting mats can be joined together.

Tie means are passed through the aligned holes 11 and 21 to join adjacent ones of groups 15A, 15B, etc. together while at the same time holding the members 3 in each group 15A, 15B, etc. together at their ends 17 between their respective plates 19. In one embodiment shown in FIGS. 1, 3 and 4, the tie means can comprise tie bolts 25. Nuts 27, threaded on the ends of the tie bolts 25, hold the members 3 together as shown in FIGS. 3 or 4. The tie bolts 25 hingedly join adjacent ones of groups 15A, 15B, etc. together. To maintain a predetermined width of the mat 1 at its ends, the free or non-interleaved ends of the members 3 in the end groups 15A and 15E can be separated by spacers 29. The mat 1, so constructed, may be made in one or two standard widths, such as approximately 24 or 36 inch widths for example, and of any suitable length.

Figure 5:
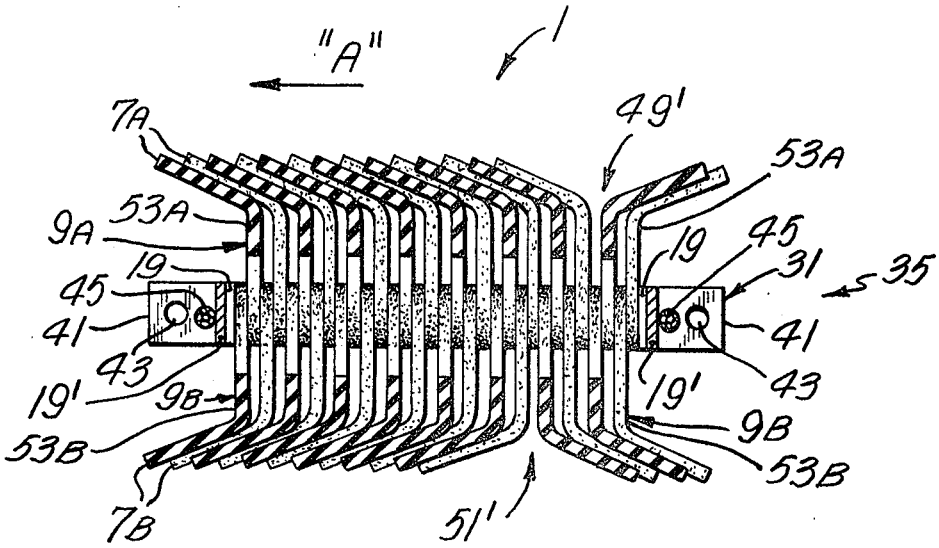
FIG. 5 is a cross-sectional view similar to FIG. 3 showing details of other embodiments of blasting mats.

To form a larger protective cover than that provided by one mat, two or more mats 1 may be joined in side-by-side relationship. To be able to join the mats in this manner, each mat is provided with rigid joining means 31, located along each long side 35 of the mat. These joining means 31, in one embodiment as shown in FIGS. 3 and 4, comprise eye bolts 33. One pair of eye bolts 33 is bolted onto each side plate 19 of each end group (15A and 15E) and on every other group (15C). As shown in FIG. 5, the eye bolts 33B along each side 35B of one mat 1B can be aligned with, and bolted to by bolts 37, eye bolts 33A on one side 35A of a second mat 1A and eye bolts 33C on one side 35C of a third mat 1C to form a larger protective cover.

The eye bolts 33 on each mat also provide means for receiving lifting cables so that the mats can be easily handled in the field.

To protect the eye bolts 33 from damage during blasting, the mat has suitable protective means. Preferably, these protective means are provided by the tread portion 7 of the outer arcuate members 3 in each group 15 of the mat. To this end, approximately half the members 3 in each group is arranged as a set 41 with their tread portions 7 facing in one direction and the other half of the members 3 is arranged as a second set 43 with their tread portions 7 facing in the opposite direction. The outer tread portions 7 of each set 41, 43, as seen in FIG. 3, overlie the eye bolts 33 associated with each set and thus protect them during blasting.

Figure 1:
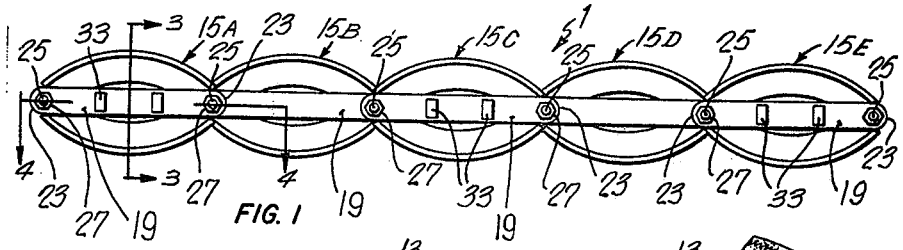
FIG. 1 is a front view of one embodiment of the blasting mat of the present invention.

Preferably, the mat is constructed to have two usable surfaces. Therefore, in assembling each group 15, every second arcuate member 3B is inverted so that its tread portion 7B faces away from the tread portion 7A of the adjacent, non-inverted members 3A as shown in FIGS. 1 and 3. This provides tread portions on both mat surfaces, and protection for the eye bolts 33 form either side, thus permitting either surface of the mat to be placed adjacent the blasting area.

Figure 6:
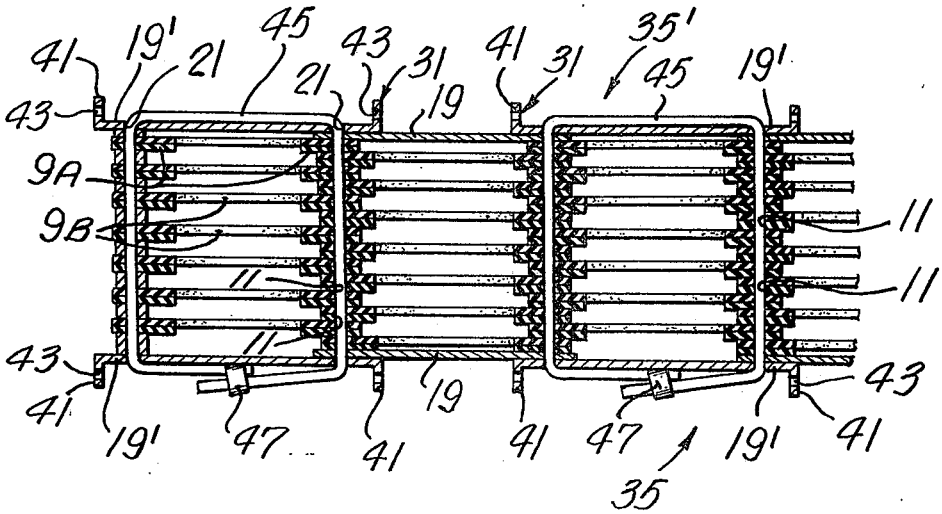
FIG. 6 is a cross-sectional view similar to FIG. 4 showing details of the other embodiments shown in FIG. 5.

In another embodiment of the invention, as shown in FIGS. 5 and 6, the rigid joining means 31 can comprise out-turned ends 41 of every second rigid side plate 19′ on each side of the mat. Each out-turned end 41 has a through hole 43 which is substantially perpendicular to the mounting hole 21 in the plate adjacent each end 41. The ends 41 of the side plates 19′ can replace the separate eye bolts 33 used in joining mats together in side-by-side relationship thus providing a more inexpensive mat.

In still another embodiment of the invention, as shown in FIGS. 5 and 6, the tie means can comprise cables 45 instead of the bolts 25. Each cable 45 replaces two tie bolts 25, with the cables passing from one side 35 of the mat to the other side 35′ through one set of aligned holes 11, along one side plate 19 to the next adjacent set of aligned holes 11, and through these holes back to the one side 35 of the mat where the cable ends are joined by a suitable clamp 47.

The cables 45 can be used with either the flat side plates 19, shown in FIGS. 3, 4 or the alternative arrangement of flat side plates 19 and side plates 19′ with out-turned ends 41, as shown in FIGS. 5,6.

When the members 3 in each group 15 of a two surfaced mat are arranged in sets 41, 43 as shown in FIG. 3, with the tread portions 7A and 7B of the members 3 in set 41 facing out in one direction and the tread portions 7A and 7B of the members 3 in the other set 43 facing out in the opposite direction, a gap may appear where the sets 41, 43 abut particularly if the tie rods or cables are not very tight. The gap can occur because the change-overs 49, 51 in direction of the tread portions 7A, 7B takes place at the same time on both surfaces. To minimize the possibility of a gap, it is preferred to have the changeover 49′ of the direction in which the tread portions 7A face, occur on the one surface, at a slightly different location from the changeover 51′ of the direction in which tread portions 7B face in the other mat surface. This is shown in FIG. 5 where the changeover 51′ in tread direction on the bottom surface occurs at a location spaced from changeover 49′ on the top surface by a few members.

A problem is sometimes encountered in threading the members 3 on rods or tubes when assembling the members 3 into a mat 1. It has been found that the members 3 are usually more easily threaded when the inner surface 53 of the casing leads during threading.

Why this is so is not known. However, when threading the members 3 onto a rod or tube in the direction of arrow A as shown in FIG. 5, it is easier when surfaces 53A, 53B of casing sections 9A, 9B lead. Thus it is preferred to delay the changeovers 49, 51, or 49′, 51′ until nearly all of the members 3 are threaded with surfaces 53A, 53B leading. Thus only a few members 3, with the inner surfaces 53A, 53B now trailing which makes for more difficult threading, need be threaded. The changeovers 49, 51, or 49′, 51′ are therefore preferably located near or adjacent one side 35, 35′ of the mat rather than in the middle of the mat.

Mats made in accordance with the present invention provide the following advantages:

A plurality of these mats can reduce the expense involved in blasting operations by eliminating the need of having to keep many different large-sized mats on hand. For each job, the proper size cover can be built up by joining together the required number of smaller-sized mats constructed according to the present invention.

A further advantage is that if one mat is damaged during blasting, in using the protective cover made of several mats, the damaged mat can be readily replaced without having to replace the entire protective cover.

Another advantage is that the mats can be readily handled individually in the field, since they need not be joined until required at the job site.

We claim:

1. A blasting mat comprising a plurality of flexible, resilient members; rigid joining means along at least one side of the mat for use in detachably, hingedly joining the mat to at least one other similar mat; and protective means covering the joining means to prevent damage to the joining means during blasting.

2. A blasting mat as claimed in claim 1 wherein the protective means are formed by a portion of some of the flexible, resilient members forming the mat.

3. A blasting mat as claimed in claim 1 wherein the flexible, resilient members comprise arcuate vehicle tire segments, each segment having a tire tread portion and a tire sidewall portion.

4. A blasting mat as claimed in claim 1 wherein the flexible, resilient members comprise arcuate vehicle tire segments, each segment having a tire tread portion and a tire sidewall portion, the tire segments arranged in successive, hinged-together groups.

5. A blasting mat as claimed in claim 1 wherein the flexible, resilient members comprise arcuate vehicle tire segments, each segment having a tire tread portion and a tire sidewall portion, the tire segments arranged in successive hinged-together groups, each group having one series of segments forming one mat surface, and another adjacent series of segments forming the other mat surface.

6. A blasting mat as claimed in claim 5 wherein the tread portions of the segments on one side of each series face in a direction opposite to the direction faced by the tread portions of the other segments of each series.

7. A blasting mat as claimed in claim 6 wherein the changeover in direction faced by the tread portions occurs near or adjacent one side of the mat.

8. A blasting mat as claimed in claim 6 wherein the changeover in direction faced by the tread portions in the one series occurs at a location slightly spaced from the location the changeover occurs in the other series.

9. A blasting mat comprising a plurality of arcuate members formed from vehicle tires, each member having a tire tread portion and a tire sidewall portion, the members arranged in successive, hinged-together groups and rigid joining means along the sides of at least some of groups permitting the mat to be detachably joined to a similar mat; the members in each group being arranged so as to have one of the two tire portions covering the joining means of that group from at least one side of the mat.

10. A blasting mat comprising a plurality of flexible, resilient members, each member composed of an arcuate vehicle tire segment, each segment having a tread portion and a sidewall portion, the members arranged in groups, each group having one series of segments forming one mat surface and another adjacent series of segments forming the other mat surface, the tread portions of the segments on one side of each series facing in a direction opposite to the direction faced by the tread portions of the other segments of each said series, the point of changeover in direction faced by the tread portions occuring near or adjacent one side of the mat.

11. A blasting mat as claimed in claim 10 wherein the point of changeover in direction faced by the tread portions in one series of each group occurs at a location spaced from the location the point of changeover occurs in the other series.

* * * * *

UNITED STATES PATENT OFFICE
CERTIFICATE OF CORRECTION

PATENT NO. : 3,943,853
DATED : March 16, 1976
INVENTOR(S) : Thomas Alexander Robertson and John Alfred King It is certified that error appears in the above-identified patent and that said Letters Patent are hereby corrected as shown below.

[30] Foreign Application Priority Data

Canada 165,542 Filed on March 6th, 1973

[73] Assignee: Thomas Alexander Robertson Armdale, Nova Scotia, Canada

Signed and Sealed this

First Day of March 1977

[SEAL]

*Attest:*

RUTH C. MASON
*Attesting Officer*

C. MARSHALL DANN
*Commissioner of Patents and Trademarks*